US009149700B1

(12) United States Patent
Green

(10) Patent No.: US 9,149,700 B1
(45) Date of Patent: Oct. 6, 2015

(54) QUICK START TO DRIVE FORCE

(71) Applicant: Joseph Green, Northridge, CA (US)

(72) Inventor: Joseph Green, Northridge, CA (US)

( * ) Notice: Subject to any disclaimer, the term of this patent is extended or adjusted under 35 U.S.C. 154(b) by 171 days.

(21) Appl. No.: 14/099,049

(22) Filed: Dec. 6, 2013

Related U.S. Application Data

(60) Provisional application No. 61/876,142, filed on Sep. 10, 2013.

(51) Int. Cl.

| | |
|---|---|
| ***A63K 3/00*** | (2006.01) |
| ***A63K 3/02*** | (2006.01) |
| ***A61F 5/00*** | (2006.01) |
| ***A61G 15/00*** | (2006.01) |
| ***A63B 69/00*** | (2006.01) |

(52) U.S. Cl.
CPC ..... *A63B 69/0028* (2013.01); *A63K 3/023* (2013.01); *A63K 3/02* (2013.01)

(58) Field of Classification Search
CPC ..... A63B 69/0028; A63B 23/0244; A63B 2208/02; A63B 2230/62; A63K 3/023; A63K 3/02
USPC ..... 482/14, 19; 128/DIG. 23; 602/18
See application file for complete search history.

(56) References Cited

U.S. PATENT DOCUMENTS

| | | | | |
|---|---|---|---|---|
| 1,636,086 | A * | 7/1927 | Wolfe | 473/274 |
| 3,244,421 | A * | 4/1966 | Hanna | 473/273 |
| 3,536,329 | A * | 10/1970 | Edwards | 473/211 |
| 3,697,065 | A * | 10/1972 | Glassburner, Jr. | 482/14 |
| 4,300,765 | A * | 11/1981 | Stringham | 473/458 |
| 4,319,362 | A * | 3/1982 | Ettinger | 2/415 |
| 5,242,377 | A | 9/1993 | Boughner et al. | |
| 5,507,718 | A * | 4/1996 | Kabat | 602/18 |
| D404,455 | S * | 1/1999 | Gella et al. | D21/791 |
| 2005/0049114 | A1 | 3/2005 | Joseph | |
| 2011/0287897 | A1* | 11/2011 | Ford | 482/19 |

* cited by examiner

*Primary Examiner* — Oren Ginsberg
*Assistant Examiner* — Joshua Lee
(74) *Attorney, Agent, or Firm* — RG Patent Consulting, LLC; Rachel Gilboy

(57) ABSTRACT

An athletic aid specially designed for track and field participants. Design intent is to provide a simple yet effective tool in improving starting techniques and increasing speed when coming out of starting blocks. Resistance means is provided. Further, proper muscle memory is promoted via a chin.

19 Claims, 5 Drawing Sheets

QUICK START TO DRIVE FORCE

CROSS-REFERENCE TO RELATED APPLICATION

The present application is related to and claims priority from prior provisional application Ser. No. 61/876,142, filed Sep. 10, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of sporting apparatuses and more specifically relates to the quick start to drive force.

2. Description of the Related Art

Sports are a common-place activity in modern society. Many individuals participate in sports for entertainment, for competition, for promoting fitness, as amateurs or for making a living as a professional athlete. Sports may be team or individual in nature. Sporting events may include for example football, hockey, tennis, track and field and soccer. Athletes strive to be stronger, faster and look to apparatuses to help them in these endeavors. Athletes also look to develop proper form which may not be easy to achieve. Many athletes that compete in track and field running events desire that they would have a safe, reliable means to train and efficiently leave the blocks in a proper posture.

Various attempts have been made to solve problems found in sporting and training apparatus art. Among these are found in: U.S. Pat. No. 3,697,065 to Thomas M. Glassburner et al; U.S. Pub. No. 2005/0049114 to Scott R. Watterson et al; and U.S. Pat. No. 5,242,377 to Robert L. Boughner et al. This prior art is representative of sporting apparatuses. None of the above inventions and patents, taken either singly or in combination, is seen to describe the invention as claimed.

Ideally, a quick start to drive force system should provide a simple yet effective tool in improving starting techniques and increasing speed when coming out of starting blocks and, yet would operate reliably and be manufactured at a modest expense. Thus, a need exists for a reliable quick start to drive force system to avoid the above-mentioned problems.

BRIEF SUMMARY OF THE INVENTION

In view of the foregoing disadvantages inherent in the known sporting apparatus art, the present invention provides a novel quick start system. The general purpose of the present invention, which will be described subsequently in greater detail is to provide a means for promoting maximization of efficiency of runners coming out of the blocks.

A quick start training aid system is disclosed herein in a preferred embodiment comprising: a wearable accessory (that is fitted and securely worn around a neck of a user via a drawstring fastener, just underneath a chin of the user, the chin protruding over the wearable accessory during an in-use condition, the wearable accessory for promoting proper head to chest alignment in the user for running when leaving starting blocks), and a starting blocks assembly (comprising a rack, a left block and a right block with ½ spheres, a left ½ sphere located on the left block and a right ½ sphere located on the right block, each forwardly-facing so as to contact a left shoe and a right shoe respectively of the user when positioned for starting, the left ½ sphere and the right ½ sphere are mounted normally in a tensioned state, and an anchor for stabilizing the starting blocks assembly).

The quick start training aid system comprises the wearable accessory, and the starting blocks assembly in functional combination. The wearable accessory in preferred embodiments comprises a cylindrical plastic pipe-like member sheathed in foam for comfort during use, wherein the cylindrical plastic pipe-like member measures about five inches in length and two inches in width to promote the proper head to chest alignment in the user. The user, by using the wearable accessory, is able to prevent raising the head too quickly after leaving the starting blocks (training enforced to muscle memory), thereby optimizing velocity and propulsion of the user, and thus increasing speed out of the blocks and down the track. The user engages the starting blocks assembly prior to a race wearing the wearable accessory. The starting blocks assembly comprises in combination the rack coupled to the anchor and the left block and the right block.

The left ½ sphere and the right ½ sphere are placed such that when proper 'leaving' of (from contact with) the starting blocks occurs the left ½ sphere and the right ½ sphere compress then decompress and remain in contact with the right block and the left block. The quick start training aid system is useful to assist track-and-field athletes in achieving sound starting techniques as well as increased initial exit-speed upon leaving the starting blocks.

The balls (½ spheres) are of (3) sizes that nestibly fit inside one-another, they are pre-molded like tennis balls to retain their structure. The easiest ball to compress, is the largest one that fits inside the retainer-rim. When the runner uses sufficient force and correct form, out of the starting blocks, the ball will compress. The ball will then "pop" back to its original shape once the runner has left the blocks. If the ball does not compress, the runner is not using the starting blocks efficiently. As the runner develops his starting ability, increases his ability to place sufficient force, that suppresses the ball consistently, another ball is then added to the initial ball, creating more resistance and the need for more 'drive force', out of the starting blocks. The balls retain their initial force, like a tennis ball. After compression, it immediately springs back to its original form.

A kit including: the starting blocks assembly, the wearable accessory, a plurality of the left ½ spheres, and a plurality of the right ½ spheres is also described herein.

A method of using a quick start training aid system is also disclosed herein comprising the steps of: setting up a starting blocks assembly, coupling a left ½ sphere on a left block and coupling a right ½ sphere on a right block to create a first resistance, (the runner) positioning (his/her shoes) against the starting blocks assembly to overcome the first resistance, and (the runner) leaving the starting blocks assembly to run a race. The method may further comprise the steps of nesting a plurality of the left ½ spheres and the right ½ spheres to increase resistance. This may be for practice use only depending on game regulations for sporting accessories used. Springs and other resistance-imparting-means may alternately be used and achieve a similar purpose.

The present invention holds significant improvements and serves as a quick start system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, quick start system, constructed and operative according to the teachings of the present invention.

The various embodiments of the present invention will hereinafter be described in conjunction with the appended drawings, wherein like designations denote like elements.

DETAILED DESCRIPTION

Figure 1:
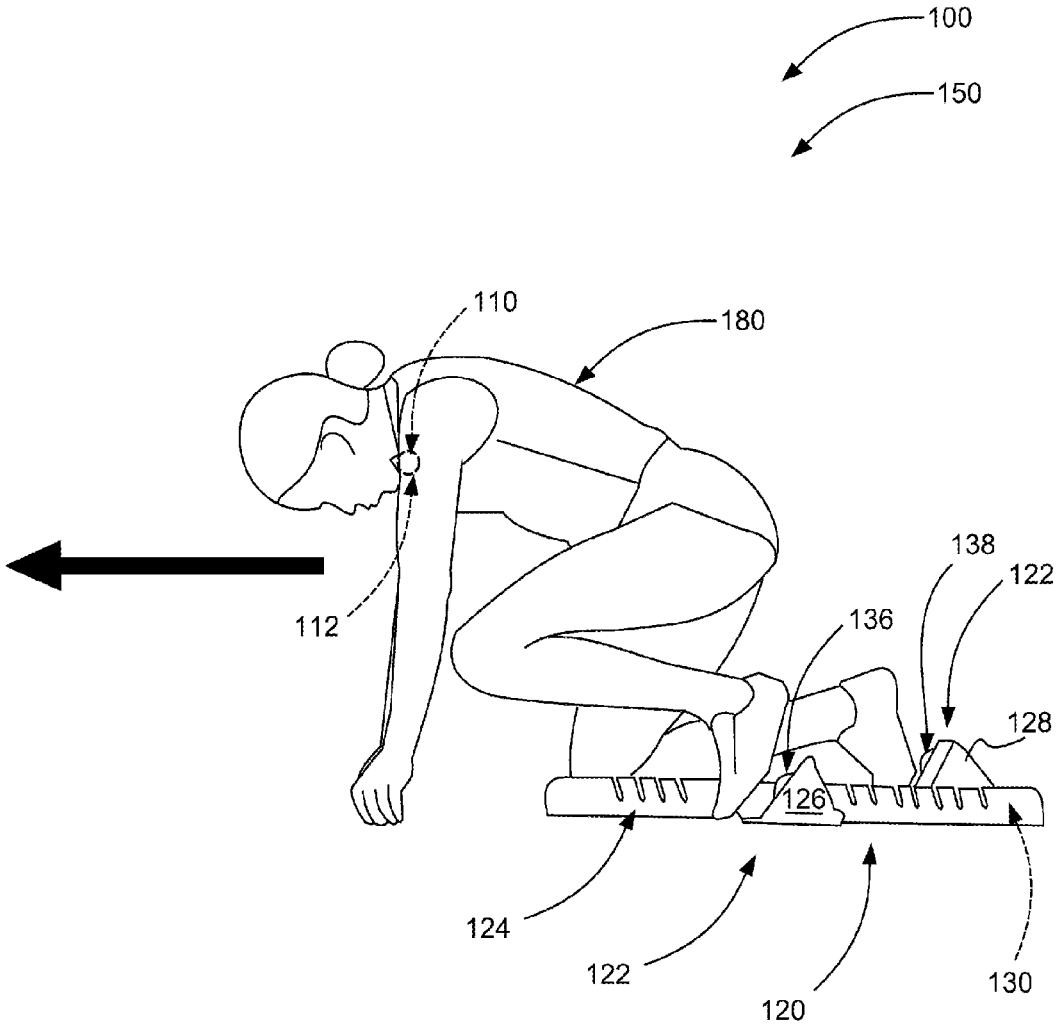
FIG. 1 shows a perspective view illustrating a quick start system in an in-use condition according to an embodiment of the present invention.

As discussed above, embodiments of the present invention relate to a sporting apparatus and more particularly to a quick start system as used to improve the speed and efficiency of runners.

Generally speaking, the 'quick start' comprises a fully functional training aid specially designed to assist track-and-field athletes in achieving sound starting techniques as well as increased speed upon exiting the starting block. Thus, this product may comprise a two-part kit to achieve these goals, detailed in more specificity subsequently.

Part one of the quick start (present system) may be comprised of a wearable accessory that is fitted around the neck, just underneath the chin. A cylindrical plastic pipe-like device is sheathed in a comfortable foam, this component may measure approximately five inches (5") in length and two inches (2") in width. A handy drawstring fastener may be provided to securely fit this unit around the neck of the athlete. When placed into position, this component may rest so that the wearer can lower the chin over the cylinder. As such, part one of the quick start may help the runner keep his or her head properly tucked into position when leaving the starting block. Keeping the product held in place for a certain distance, the runner is able to prevent raising the head too soon after leaving the starting block, optimizing velocity and propulsion of the body, and thus increasing speed.

Part two of the quick start system may be assembled at the starting block itself. Resting between the starting block and the runner's foot may be an automated system comprised of two (2) tennis balls, cut in half, with each half circle positioned on either side of the starting block. This system may be set to automatically 'pop' forward (based on the ½ spheres returning back to their normal condition) to indicate that the runner is correctly leaving the starting block; a missed step or false start may result in the half-balls remaining place. Relatively simple in design yet extremely effective in application, the quick start system may be set up at the block and on the athlete in a matter of minutes. As a result, track-and-field athletes may be able to repeatedly practice with the quick start, perfecting techniques with each attempt.

The quick start is an invention that may offer a number of important benefits and advantages. Foremost, this practical training aid may provide track-and-field athletes with a unique method of improving their starts as well as their runs. Offering an instant visual indicator that he or she is propelling correctly from the starting block at the sound of the gun, the quick start's "pop action" tennis balls may alleviate any confusion concerning one's starting precision while helping the athlete practice and then maintain sure foot placement while in position. In this manner, this part of the quick start may help ensure against slippage, false starts, and other hindrances that can instantly compromise a successful run. Continuing with assistance after the runner leaves the block, the system's handy chin device may prove an invaluable training tool in proper head positioning while running, eliminating the risk that the athlete will raise his or her head before achieving optimal velocity. Developed by an experienced track-and-field coach and successfully implemented in his training, the quick start may offer a proven method of achieving athletic glory, whether one is engaging in sprints, middle-distance, long-distance, hurdles, or relays.

The quick start is an innovative product invention that may readily enhance the track-and-field experience for all who participate. Universal in design and extremely easy to use, this product may be quickly mastered by runners of both sexes, as well as both novice and seasoned athletes.

Referring to the drawings by numerals of reference there is shown in FIG. 1, a perspective view illustrating quick start training aid system 100 in an in-use condition 150 according to an embodiment of the present invention.

Quick start training aid system 100 comprises: wearable accessory 110 (that is fitted and securely worn around a neck of user 180 preferably via a drawstring fastener, just underneath a chin of user 180, the chin protruding over the wearable accessory during an in-use condition, the wearable accessory 110 (shown in dashed lines) for promoting proper head to chest alignment in user 180 for running when leaving starting blocks 122—starting blocks is inter-changeably used to refer to starting blocks assembly 120 within this disclosure), starting blocks assembly 120 (comprising rack 124, left block 126 and right block 128 with ½ spheres, (left ½ sphere 136 located on left block 126 and right ½ sphere 138 located on right block 128, each forwardly-facing (as shown in FIG. 1) so as to contact a left shoe and a right shoe respectively of user 180 when positioned for starting, and anchor 130 for stabilizing starting blocks assembly 120).

Quick start training aid system 100 comprises wearable accessory 110, and starting blocks assembly 120 in functional combination, wherein starting blocks assembly 120 comprises in combination rack 124 coupled to anchor 130 and left block 126 and right block 128. User 180 engages the starting blocks assembly 120 (as shown) prior to a race (practice or other) wearing wearable accessory 110. Quick start training aid system 100 is useful to assist track-and-field athletes (user 180) in achieving sound starting techniques as well as increased initial exit-speed upon leaving starting blocks 122.

Figure 2:
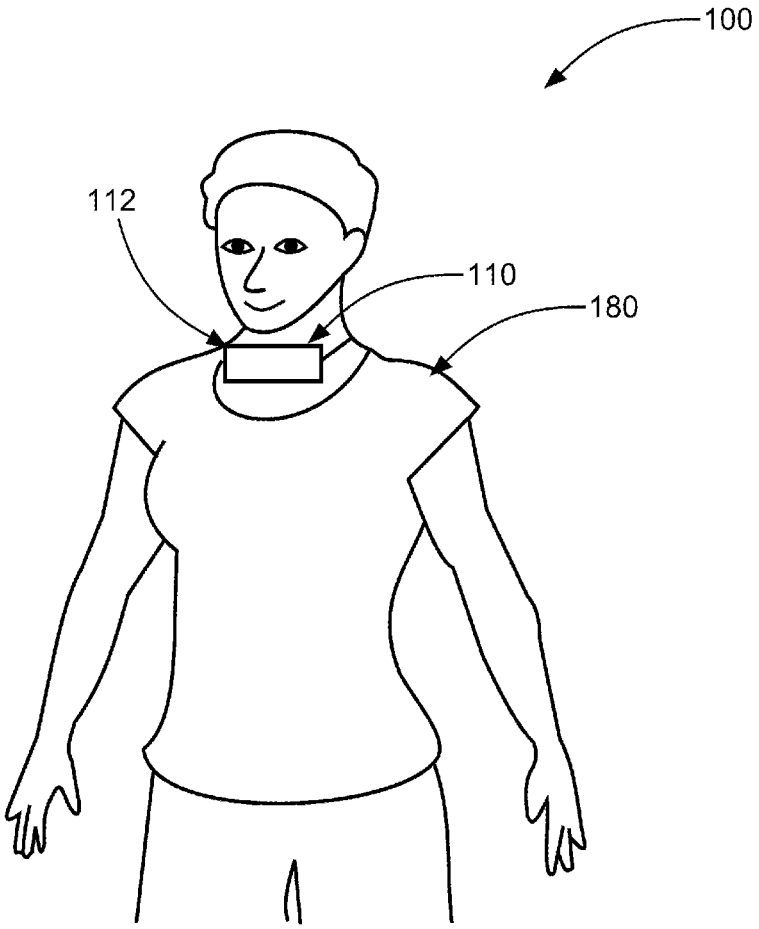
FIG. 2 is a perspective view illustrating a chin device (wearable assembly) in use on an athlete according to an embodiment of the present invention.
Figure 3:
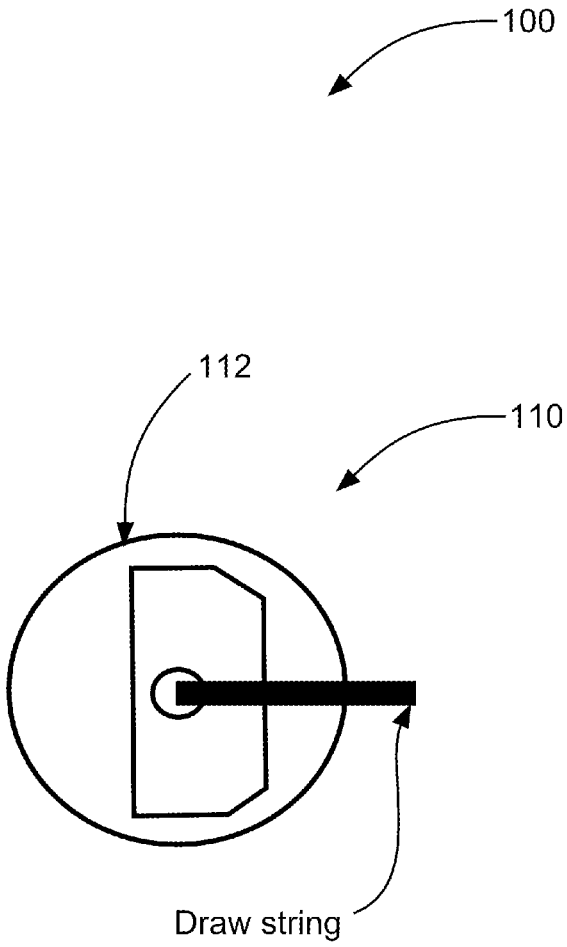
FIG. 3 is a cross-sectional view illustrating the chin device according to an embodiment of the present invention.

Referring now to FIGS. 2 and 3, perspective views illustrating chin device (wearable assembly 110) in use on an athlete (user 180) and by itself according to an embodiment of the present invention.

Wearable accessory 110 comprises cylindrical plastic pipe-like member 112 sheathed in foam for comfort during use in preferred embodiments. Cylindrical plastic pipe-like member 112 preferably measures about five inches in length and two inches in width to promote the proper head to chest alignment in user 180 (as shown in FIG. 1). User 180, by using wearable accessory 110, is able to develop muscle memory to help prevent raising the head too quickly after leaving starting blocks 122, thereby optimizing velocity and propulsion of user 180, and thus increasing speed (times to finish race distance are decreased).

Figure 4:
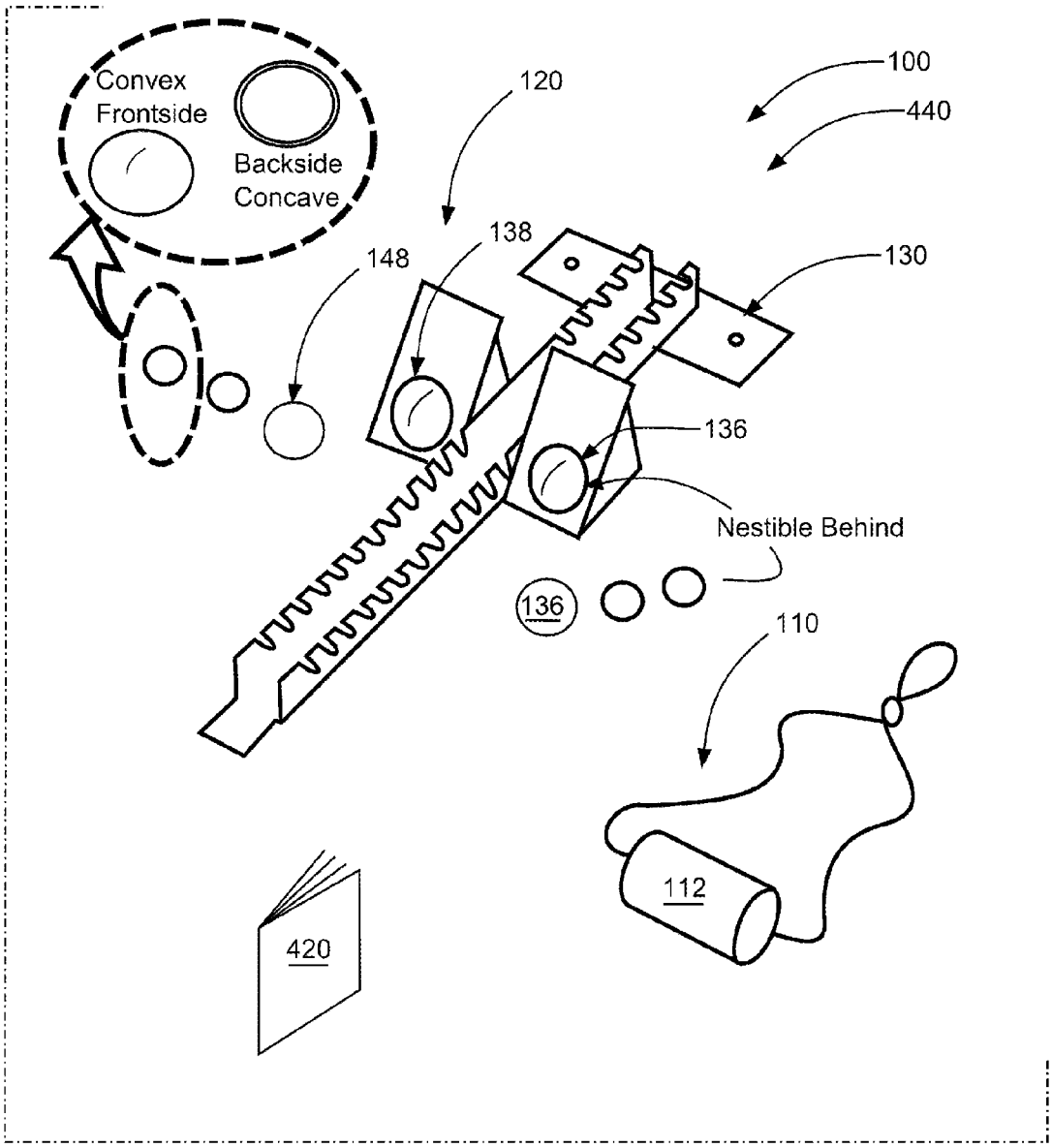
FIG. 4 is a perspective view illustrating a starting blocks assembly according to an embodiment of the present invention of FIG. 1.

Referring now to FIG. 4, a perspective view illustrating starting blocks assembly 120 according to an embodiment of the present invention of FIG. 1.

Starting blocks assembly 120 comprises at least left ½ sphere 136 and right ½ sphere 138. Left ½ sphere 136 and right ½ sphere 138 are each removable. Right ½ sphere 138 is removably couplable to right block 128; and left block 126 is removably couplable to the left ½ sphere 136. Right ½ sphere 138 is removably couplable to right block 128 and left block 126 is removably couplable to left ½ sphere 136 such that a right sole of a right running shoe contacts right ½ sphere 138 and a left sole of a left running shoe contacts left ½ sphere 136 before a race is commenced. Left ½ sphere 136 and right ½ sphere 138 are mounted normally in a tensioned state (rounded outwardly—convex orientation to mated block). Left ½ sphere 136 and the right ½ sphere 138 are placed such that when proper leaving (exiting) of the starting blocks 122 occurs left ½ sphere 136 and right ½ sphere 138 compress then decompress and remain in contact with right block 128 and left block 126, respectively.

Left ½ sphere 136 and right ½ sphere 138 are placed such that when false start and improper leaving (exiting) of starting blocks 122 occurs left ½ sphere 136 and right ½ sphere 138 compress then decompress and do not remain in contact with right block 128 and left block 126. Left ½ sphere 136 and right ½ sphere 138 are used to create a first resistance. Second left ½ sphere 146 and second right ½ sphere 148 may be used to create a second resistance. Second left ½ sphere 146 is nestable within left ½ sphere 136 and second right ½ sphere 148 is nestable within right ½ sphere 138. Second resistance is greater than the first resistance to promote a necessity for user 180 to place greater pressure on starting blocks assembly 120 and thereby increase launch speed. Other left and right ½ spheres may be used (indicated in the present FIG. 4) and preferably nest within one another sequentially to create more and more (increased) resistance. Those with ordinary skill in the art will now appreciate that upon reading this specification and by their understanding the art of resistance providing means as described herein, methods of providing resistance such as springs or the like will be understood by those knowledgeable in such art.

Quick start training aid system 100 may be sold as kit 440 comprising the following parts: at least one starting blocks assembly 120, wearable accessory 110, a plurality of left ½ spheres 136, a plurality of right ½ spheres 138 (may include at least second left ½ sphere 146, and second right ½ sphere 148); and at least one set of user instructions. The kit 440 has instructions such that functional relationships are detailed in relation to the structure of the invention (such that the invention can be used, maintained, or the like in a preferred manner). Quick start training aid system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
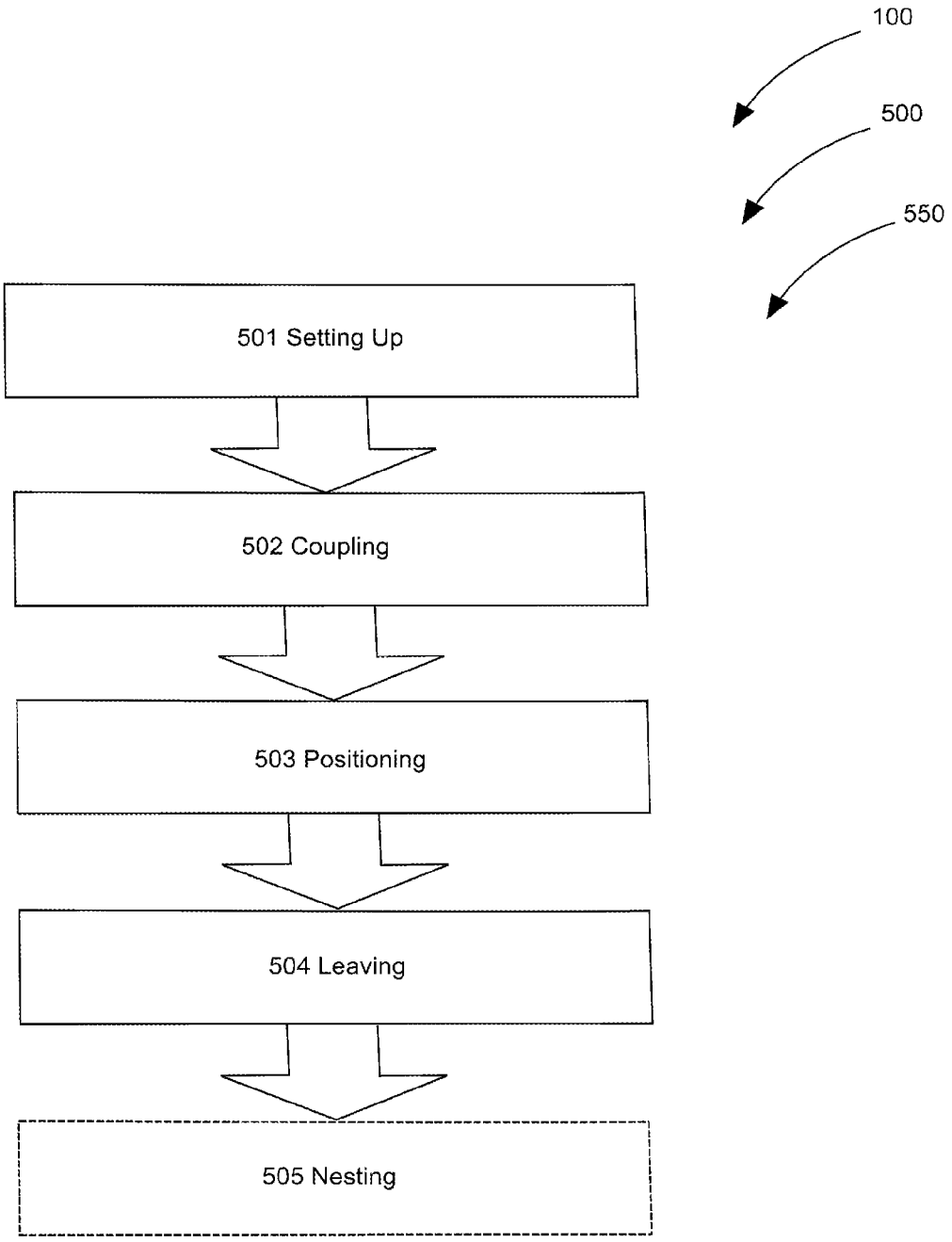
FIG. 5 is a flowchart illustrating a method of use for the quick start training aid system according to an embodiment of the present invention of FIGS. 1-4.

Referring now to FIG. 5, flowchart 550 illustrating a method of use 500 for the quick start training aid system 100 according to an embodiment of the present invention of FIGS. 1-4.

A method of using (method of use 500) a quick start training aid system 100 may comprise the steps of: step one 501 setting up a starting blocks assembly 120, step two 502 coupling left ½ sphere 136 on left block 126 and coupling right ½ sphere 138 on right block 128 to create a first resistance, step three 503 positioning wearable accessory 110 and placing feet against starting blocks assembly 120 to overcome the first resistance, and step four 504 leaving starting blocks assembly 120 to run a race (practice or the like). Method of use 500 may further comprise the step five 505 of nesting a plurality of the left ½ spheres and the right ½ spheres (such as second left ½ sphere 146 and second right ½ sphere 148) to increase resistance. Third and fourth spheres for example may be used at this juncture.

It should be noted that step 505 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A quick start training aid system comprising:

a wearable accessory that is fitted and securely worn around a neck of a user via a drawstring fastener, just underneath a chin of said user, said chin protruding over said wearable accessory during an in-use condition, wherein said wearable accessory promotes proper head to chest alignment in said user for running when leaving starting blocks;

a starting blocks assembly comprising;

a rack;

a left block and a right block with ½ spheres, a left ½ sphere located on said left block and a right ½ sphere located on said right block, each ½ sphere forwardly-facing so as to contact a left shoe and a right shoe respectively of said user when positioned for starting; and an anchor for stabilizing said starting blocks assembly;

wherein said quick start training aid system comprises said wearable accessory, and said starting blocks assembly in functional combination;

wherein said starting blocks assembly comprises in combination said rack coupled to said anchor and said left block and said right block;

wherein said user engages said starting blocks assembly prior to a race wearing said wearable accessory; and wherein said quick start training aid system is useful to assist track-and-field athletes in achieving sound starting techniques as well as increased initial exit-speed upon leaving said starting blocks assembly.

2. The quick start training aid system of claim 1 wherein said wearable accessory comprises a cylindrical plastic pipe-like member sheathed in foam for comfort during use.

3. The quick start training aid system of claim 2 wherein said cylindrical plastic pipe-like member measures about five inches in length and two inches in width to promote said proper head to chest alignment in said user.

4. The quick start training aid system of claim 1 wherein said user by using said wearable accessory is able to prevent raising said chin too quickly after leaving said starting blocks assembly, thereby optimizing velocity and propulsion of the user, and thus increasing speed.

5. The quick start training aid system of claim 1 wherein said left ½ sphere and said right ½ sphere are each removable.

6. The quick start training aid system of claim 5 wherein said right ½ sphere is removably couplable to said right block.

7. The quick start training aid system of claim 5 wherein said left block is removably couplable to said left ½ sphere.

8. The quick start training aid system of claim 7 wherein said right ½ sphere is removably couplable to said right block and said left block is removably couplable to said left ½ sphere such that a right sole of a right running shoe contacts said right ½ sphere and a left sole of a left running shoe contacts said left ½ sphere before a race is commenced.

9. The quick start training aid system of claim 8 wherein said left ½ sphere and said right ½ sphere are mounted normally in a tensioned state.

10. The quick start training aid system of claim 9 wherein said left ½ sphere and said right ½ sphere are placed such that when proper leaving of said starting blocks assembly occurs said left ½ sphere and said right ½ sphere compress then decompress and remain in contact with said right block and said left block.

11. The quick start training aid system of claim 1 wherein said left ½ sphere and said right ½ sphere are placed such that when false start and improper leaving of said starting blocks assembly occur said left ½ sphere and said right ½ sphere compress then decompress and do not remain in contact with said right block and said left block.

12. The quick start training aid system of claim 10 wherein said left ½ sphere and said right ½ sphere are used to create a first resistance.

13. The quick start training aid system of claim 12 wherein a second left ½ sphere and a second right ½ sphere are used to create a second resistance.

14. The quick start training aid system of claim 13 wherein said second left ½ sphere is nestable within said left ½ sphere and said second right ½ sphere is nestable within said right ½ sphere.

15. The quick start training aid system of claim 14 wherein said second resistance is greater than said first resistance to promote a need for said user to place greater pressure on said starting blocks assembly and thereby increasing launch speed.

16. A quick start training aid system comprising:

a wearable accessory that is fitted and securely worn around a neck of a user via a drawstring fastener, just underneath a chin of said user, said chin protruding over said wearable accessory during an in-use condition, wherein said wearable accessory promotes proper head to chest alignment in said user for running when leaving starting blocks;

a starting blocks assembly comprising;

a rack;

a left block and a right block with ½ spheres, a left ½ sphere located on said left block and a right ½ sphere located on said right block, each ½ sphere forwardly-facing so as to contact a left shoe and a right shoe respectively of said user when positioned for starting, said left ½ sphere and said right ½ sphere are mounted normally in a tensioned state; and an anchor for stabilizing said starting blocks assembly;

wherein said quick start training aid system comprises said wearable accessory, and said starting blocks assembly in functional combination;

wherein said starting blocks assembly comprises in combination said rack coupled to said anchor and said left block and said right block;

wherein said wearable accessory comprises a cylindrical plastic pipe-like member sheathed in foam for comfort during use;

wherein said cylindrical plastic pipe-like member measures about five inches in length and two inches in width to promote said proper head to chest alignment in said user;

wherein said user by using said wearable accessory is able to prevent raising said chin too quickly after leaving said starting blocks assembly, thereby optimizing velocity and propulsion of the user, and thus increasing speed;

wherein said user engages said starting blocks assembly prior to a race wearing said wearable accessory;

wherein said left ½ sphere and said right ½ sphere are placed such that when proper leaving of said starting blocks assembly occurs said left ½ sphere and said right ½ sphere compress then decompress and remain in contact with said right block and said left block; and wherein said quick start training aid system is useful to assist track-and-field athletes in achieving sound starting techniques as well as increased initial exit-speed upon leaving said starting blocks assembly.

17. The quick start training aid system of claim 16 further comprising a kit including: said starting blocks assembly;

said wearable accessory; a plurality of said left ½ spheres; and a plurality of said right ½ spheres.

18. A method of using a quick start training aid system comprising the steps of:

setting up a starting blocks assembly;

coupling a left ½ sphere on a left block and coupling a right ½ sphere on a right block to create a first resistance;

positioning a wearable accessory around a neck of a user via a drawstring fastener, just underneath a chin of said user; placing shoes against said starting blocks assembly to overcome said first resistance; and leaving said starting blocks assembly to run a race.

19. The method of claim 18 further comprising the step of nesting a plurality of said left ½ spheres and said right ½ spheres to increase resistance.

* * * * *